US008761645B2

(12) United States Patent
Deguchi et al.

(10) Patent No.: US 8,761,645 B2
(45) Date of Patent: Jun. 24, 2014

(54) TRANSFER APPARATUS

(75) Inventors: Hideaki Deguchi, Nagoya (JP); Keita Hironaka, Obu (JP); Yusuke Ozaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 97 days.

(21) Appl. No.: 13/361,992

(22) Filed: Jan. 31, 2012

(65) Prior Publication Data

US 2012/0243918 A1 Sep. 27, 2012

(30) Foreign Application Priority Data

Mar. 25, 2011 (JP) ..... 2011-068111

(51) Int. Cl.
*G03G 15/16* (2006.01)
*G03G 15/00* (2006.01)

(52) U.S. Cl.
CPC ..... *G03G 15/16* (2013.01); *G03G 15/165* (2013.01); *G03G 15/167* (2013.01); *G03G 15/6558* (2013.01); *G03G 2215/1609* (2013.01); *G03G 2215/00409* (2013.01)
USPC ..... 399/316; 399/317

(58) Field of Classification Search
CPC ..... G03G 15/16
USPC ..... 396/316–317; 399/316–317
See application file for complete search history.

(56) References Cited

U.S. PATENT DOCUMENTS 5,453,823 A * 9/1995 Hashizume et al. ..... 399/316
6,512,904 B2 * 1/2003 Sato et al. ..... 399/111
7,113,734 B2 * 9/2006 Deguchi et al. ..... 399/316
7,346,304 B2 3/2008 Takagi
7,539,447 B2 * 5/2009 Hattori et al. ..... 399/316
7,542,709 B2 * 6/2009 Uehara et al. ..... 399/316
2005/0069343 A1 * 3/2005 Deguchi et al. ..... 399/111
2006/0171760 A1 8/2006 Deguchi
2006/0238788 A1 10/2006 Takagi
2007/0269242 A1 * 11/2007 Hattori et al. ..... 399/316
2007/0269243 A1 11/2007 Uehara et al.
2007/0269244 A1 11/2007 Miwa et al.

FOREIGN PATENT DOCUMENTS

CN 100527012 C 8/2009
JP 2003-005535 1/2003

(Continued)

OTHER PUBLICATIONS

Office Action issued in corresponding Chinese Patent Application No. 201210021355.X mailed Mar. 31, 2014.

*Primary Examiner* — Clayton E Laballe
*Assistant Examiner* — Kevin Butler
(74) *Attorney, Agent, or Firm* — Banner & Witcoff, Ltd.

(57) ABSTRACT

A transfer apparatus includes a transfer roller which transfers developer on an image carrier onto a conveyed recording medium at a transferring portion, a supporting frame, a flexible guide member attached to the supporting frame to guide the record medium to the transferring portion, and a inflexible protrusion supporting member which is provided on the supporting frame between the transferring portion and the guide member and protrudes to support a trailing edge of the record medium after passing the guide member. The guide member includes a swing portion which is provided at one end side at a downstream thereof. The protrusion supporting member is provided to abut the guide member while the guide member does not protrude from the protrusion supporting member to a side of the transferring portion when the swing portion of the guide member swings by abutting the record medium.

5 Claims, 2 Drawing Sheets

(56) References Cited

FOREIGN PATENT DOCUMENTS

| | | |
|---|---|---|
| JP | 2006-208839 A | 8/2006 |
| JP | 2006-208840 | 8/2006 |
| JP | 2006-301490 | 11/2006 |
| JP | 2008-026808 | 2/2008 |
| JP | 2008-026809 | 2/2008 |

* cited by examiner

TRANSFER APPARATUS

CROSS-REFERENCE TO RELATED APPLICATION

This application claims priority from Japanese Patent Application No. 2011-068111, filed on Mar. 25, 2011, the entire subject matter of which is incorporated herein by reference.

TECHNICAL FIELD

Aspects of the present invention relate to a transfer apparatus which is configured to transfer developer carried on a peripheral surface of an image carrier to a conveyed record medium.

BACKGROUND

Generally, in an electro-photographic image forming apparatus such as a laser printer, an image carrier (photosensitive drum) for carrying a developer image (toner image) and a transfer roller applied with a transfer bias for electrostatically attracting the developer image from the image carrier are provided to contact each other. When a sheet passes between the image carrier and the transfer roller, the transfer roller attracts the developer image, thereby transferring the developer image onto the sheet, such that an image is formed on the sheet.

However, in such image forming apparatus, if the image carrier and the sheet are separated from each other at an upstream of a portion where the image carrier and the transfer roller contact each other in a sheet conveyance direction, electric discharge occurring between the image carrier and the sheet scatters developer to cause the image dirty. In order to cope with this problem, it is proposed to provide a guide plate for bringing the sheet to an image carrier side at the upstream of the above-described portion in the sheet conveyance direction (see JP-A-2003-5535, for example).

In this apparatus provided with the guide plate, immediately after a trailing edge of a sheet passes the guide plate, the sheet is rapidly separated from the image carrier due to the rigidity of the sheet, and thus the image is disturbed in the vicinity of the trailing edge of the sheet.

SUMMARY

An aspect of the present invention provides a transfer apparatus which can effectively suppress an image from disturbed in the vicinity of a trailing edge of a sheet.

According to an illustrative embodiment of the present invention, there is provided a transfer apparatus comprising: a transfer roller which opposes an image carrier to transfer developer carried on a peripheral surface of the image carrier onto a recording medium conveyed along a conveyance path, and is configured to rotate in synchronization with the conveyance of the record medium; a guide-member supporting frame which is provided at an upstream of a transferring portion where the image carrier and the transfer roller are closest, in the conveyance path, and is provided at a side of the transfer roller with respect to the conveyance path; a flexible guide member which has a thin plate shape as seen in a side sectional view, and is attached to the guide-member supporting frame at an upstream of the transferring portion in the conveyance path to guide the record medium to the transferring portion; and a inflexible protrusion supporting member which has a rigid shape as seen in a side sectional view, and is provided on the guide-member supporting frame between the transferring portion and the guide member in the conveyance path, and which protrudes toward the conveyance path such that the protrusion supporting member supports a trailing edge of the record medium after the trailing edge of the record medium passes the guide member. The guide member includes a fixed portion which is fixed to the guide-member supporting frame, and a swing portion which is provided at one end side thereof opposite to the fixed portion as seen along the conveyance path and at a downstream in the conveyance path to be closer to the conveyance path than the fixed portion. The protrusion supporting member is provided to abut the guide member while the guide member does not protrude from the protrusion supporting member to a side of the transferring portion when the swing portion of the guide member swings to approach the guide-member supporting frame by abutting the record medium.

In the above configuration, even if the trailing edge of the record medium passes the guide member, the trailing edge is reliably (rigidly) supported by the protrusion supporting member protruding toward the conveyance path at the downstream of the guide member. Thus, it is possible to effectively suppress the trailing edge of the record medium from being rapidly separated from the peripheral surface of the image carrier after the trailing edge of the record medium passes the guide member.

Particularly, the protrusion supporting member is provided at a position where the swing portion of the guide member does not protrude toward the transferring portion and the tip end is supported when the swing portion of the guide member swings to approach the guide member supporting frame (that is, in a direction of separating away from the conveyance path) by abutting a recording medium. Therefore, after the trailing edge of the recording medium passes the guide member, the trailing edge certainly abuts the protrusion supporting member and is reliably supported by the protrusion supporting member. Further, when a relatively thick recording medium passes, the swing portion of the guide member is reliably supported by the protrusion supporting member.

Therefore, according to the above configuration, in the vicinity of the trailing edge of the record medium, occurrence of disturbance in transfer of the developer is suppressed.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, an illustrative embodiment of the present invention will be described with reference to the accompanying drawings.

<Schematic Configuration of Laser Printer>

Figure 1:
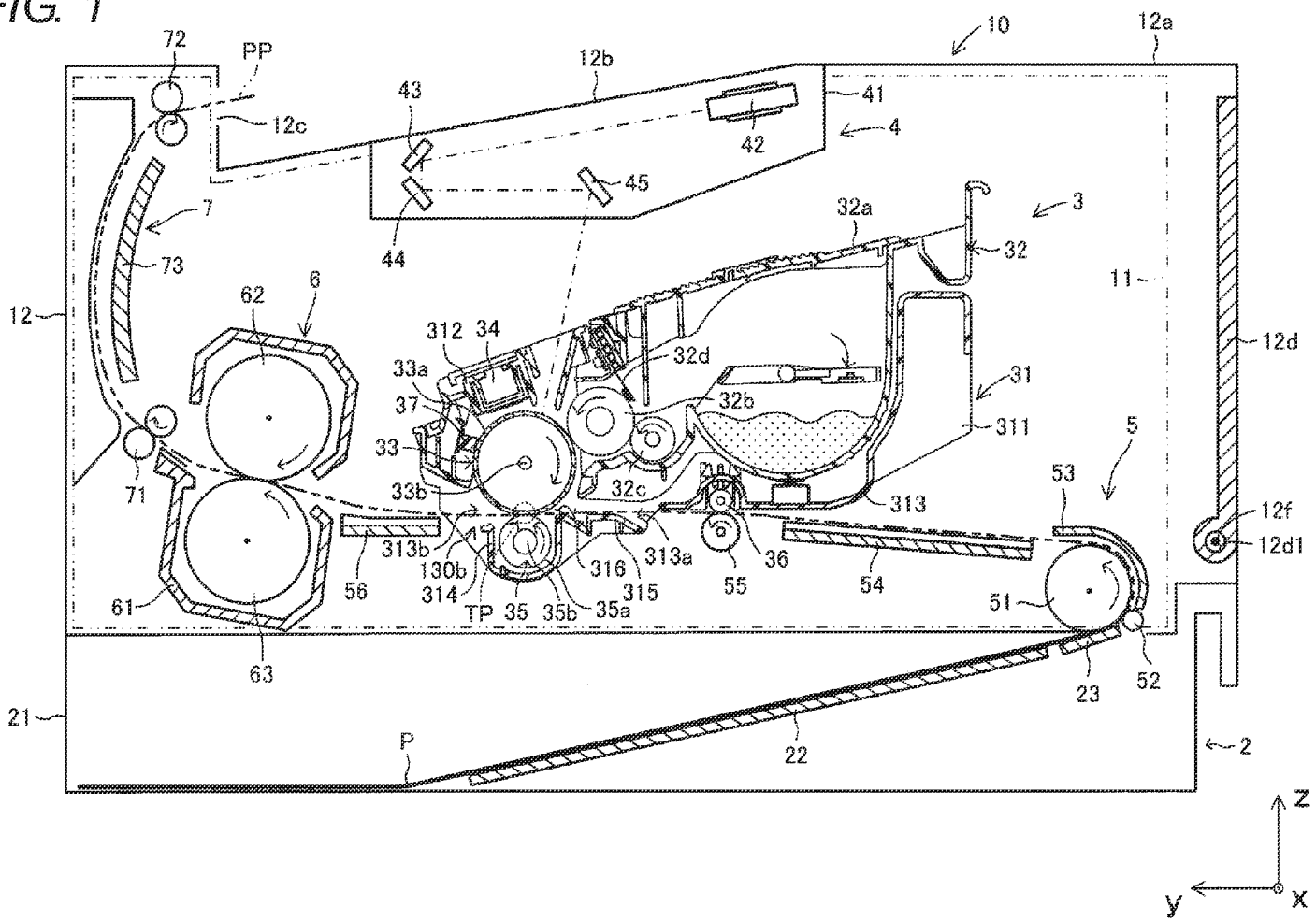
FIG. 1 is a side sectional view illustrating a schematic configuration of a laser printer according to an illustrative embodiment of the present invention.

FIG. 1 is a side sectional view illustrating a schematic configuration of a laser printer 1 which is an image forming apparatus according to an illustrative embodiment of the present invention. Hereinafter, the right side in FIG. 1 (the negative side of a y axis in FIG. 1) is referred to as a front side of the laser printer 1, and the left side in FIG. 1 (the positive side of the y axis in FIG. 1) will be referred to as a rear side of the laser printer 1. Further, a vertical direction in FIG. 1 (a z axis direction in FIG. 1) will be referred to as a height direction or a vertical direction of the laser printer 1, and a left-right direction in FIG. 1 (a y axis direction in FIG. 1) will be referred to as a front-rear direction of the laser printer. Furthermore, a direction perpendicular to the sheet plane of FIG. 1 (an x axis direction in FIG. 1) will be referred to as a width direction of the laser printer 1 or a sheet width direction.

The laser printer 1 is configured to form an image (toner image) by developer (toner) on a sheet P which is a sheet of record medium while conveying the sheet P along a sheet conveyance path PP (shown by an alternate long and two short dashes line in FIG. 2) inside the laser printer 1. Hereinafter, a conveyance direction of the sheet P along the sheet conveyance path PP in FIG. 1 (that is, a tangential direction at an arbitrary position of the sheet conveyance path PP) will be referred to as a sheet conveyance direction.

Specifically, the laser printer 1 includes a feeder unit 2, a process cartridge 3, an exposing unit 4, a sheet feeding unit 5, a fixing unit 6, and a sheet discharging unit 7. The feeder unit 2 and the process cartridge 3 are mounted on a main body unit 10 of the laser printer 1, to be removable and attachable. Also, the process cartridge 3, the exposing unit 4, the sheet feeding unit 5, the fixing unit 6, and the sheet discharging unit 7 are accommodated in the main body unit 10.

The main body unit 10 includes a main body frame 11 and an outer cover 12. The outer cover 12 is a substantially rectangular member configuring a casing of the main body unit 10, and is integrally formed with a synthetic resin plate. The outer cover 12 covers the main body frame 11 for supporting the above-described individual units accommodated in the main body unit 10, from the outside.

At an upper surface 12*a* of the outer cover 12, a sheet discharge tray 12*b* is provided. The sheet discharge tray 12*b* is a recess formed at the upper surface 12*a*, and is made by an inclined surface formed to extend obliquely downward from the front side to the rear side of the upper surface 12*a*. At an upper portion of the outer cover 12, above a lower end portion of the sheet discharge tray 12*b*, a sheet discharging port 12*c* which is an opening is formed. In other words, the sheet discharge tray 12*b* is configured to receive the sheet P discharged from the sheet discharging port 12*c*.

The front side of the outer cover 12 is formed with an opening, and a plate-shaped front cover 12*d* is provided to cover the opening. A lower edge portion of the front cover 12*d* is formed with holes 12*d*1 configuring a rotation center of the front cover 12*d*. At positions of the opening of the outer cover 12 corresponding to the holes 12*d*1, a pair of pins 12*f* are provided to project along the sheet width direction. The pins 12*f* are inserted into the holes 12*d*1 of the front cover 12*d* such that the front cover 12*d* is supported to be openable and closable around the pins 12*f*. In other words, the laser printer 1 of the present illustrative embodiment is configured such that the front cover 12*d* is opened on the front side (the right side in FIG. 1) and thus the process cartridge 3 is attachable to and removable from the front side of the laser printer 1 though the opening.

The feeder unit 2 which holds a stack of sheets P supplied to the main body unit 10 is configured to be slidable in the front-rear direction in a lower portion of the main body unit 10 so as to be attachable and removable. The feeder unit 2 includes a box-shaped feeder case 21, and a sheet pressing plate 22 and a separating pad 23 provided to the feeder case 21.

The sheet pressing plate 22 is supported to be swingable around an end portion on the rear side (the side far from the separating pad 23 in FIG. 1). An end portion of the sheet pressing plate 22 (the side close to the separating pad 23 in FIG. 1) is biased upward by a biasing means (not shown). The separating pad 23 is provided at the downstream of the sheet pressing plate 22 in the sheet conveyance direction in the vicinity of the front-side end portion of the feeder case 21, and is biased upward from below by a spring (not shown). An upper surface of the separating pad 23 is made of a material having a friction coefficient higher than that of a surface of a sheet P.

In a drum frame 31 configuring a casing of the process cartridge 3, a developer cartridge 32 is provided to be attachable and removable. A developing-unit case 32*a* configuring a casing of the developer cartridge 32 contains toner which is a nonmagnetic single-component dry developer. At the rear-side end portion of the developing-unit case 32*a*, a developing roller 32*b* is rotatably supported. The developing roller 32*b* is configured to rotate in a direction shown by an arrow in FIG. 1 when an image is formed.

On a side of the developing roller 32*b*, at a position on the inner side of the developing-unit case 32*a*, a supply roller 32*c* is rotatably supported. The supply roller 32*c* rotates in a direction shown by an arrow in FIG. 1 (the same direction as the rotation direction of the developing roller 32*b*) when an image is formed, such that the charged toner is carried on the peripheral surface of the developing roller 32*b*.

A layer-thickness regulating blade 32*d* is fixed to the developing-unit case 32*a*, such that the layer-thickness regulating blade 32*d* contacts a portion on the peripheral surface of the developing roller 32*b* at the downstream of a contact portion of the peripheral surface with the supply roller 32*c* in a movement direction of the peripheral surface by the rotation of the developing roller 32*b* as described above. The layer-thickness regulating blade 32*d* is configured such that a tip end abuts the peripheral surface of the developing roller 32*b* to adjust the density and amount of charge of the toner on the peripheral surface of the developing roller 32*b*.

The developer cartridge 32 is provided on one side of a photosensitive drum 33 accommodated in the drum frame 31. The developer cartridge 32 supplies the toner to an electrostatic latent image carrying surface 33*a* which is the peripheral surface of the photosensitive drum 33 where an electrostatic latent image is formed, such that the toner is arranged and carried in an image shape on the electrostatic latent image carrying surface 33*a* (an electrostatic latent image is developed by the toner). The photosensitive drum 33 is rotatably supported by the drum frame 31 such that the photosensitive drum 33 rotates in the direction shown by the arrow (the opposite direction to the rotation direction of the developing roller 32*b*) around a rotation shaft 33*b* in synchronization with conveyance of a sheet P when an image is formed.

Above the photosensitive drum 33, a charging unit 34 for uniformly charging the electrostatic latent image carrying surface 33*a* is provided. The charging unit 34 is supported by the drum frame 31.

In the drum frame 31, a transfer roller 35 for transferring the toner carried on the electrostatic latent image carrying surface 33*a* is accommodated. The transfer roller 35 is provided below the photosensitive drum 33 at a lower portion of the process cartridge 3, such that an upper portion of a peripheral surface 35*a* of the transfer roller 35 opposes the photosensitive drum 33 with the sheet conveyance path PP interposed therebetween at a transferring portion TP. In the present illustrative embodiment, the transfer roller 35 is configured by a conductive rubber roller capable of elastic deformation, and presses the photosensitive drum 33 and is pressed by the photosensitive drum 33 at the transferring portion TP, such that the transfer roller 35 is brought into surface contact with the photosensitive drum 33 by a predetermined width (for example, 1 mm to 2 mm) along the sheet conveyance path PP.

The transfer roller 35 is rotatably supported by the drum frame 31 around a metal rotation shaft 35*b* such that the transfer roller 35 rotates in a direction shown by an arrow in FIG. 1 (a direction allowing the transfer roller 35 to follow the rotation of the photosensitive drum 33) in synchronization with the rotation of the photosensitive drum 33 (that is, in synchronization with conveyance of a sheet P) when an image is formed. Further, the rotation shaft 35*b* is electrically connected to a power supply (not shown) such that a predetermined transfer bias voltage is applied between the transfer roller 35 and the photosensitive drum 33.

Below the drum frame 31, an upper registration roller 36 for regulating a direction and conveyance timing of a sheet P is rotatably supported. The upper registration roller 36 is provided above the sheet conveyance path PP at the upstream of the transferring portion TP where the photosensitive drum 33 and the transfer roller 35 oppose each other with the sheet conveyance path PP interposed therebetween, in the sheet conveyance direction.

In the drum frame 31, a cleaning unit 37 for cleaning the electrostatic latent image carrying surface 33*a* is provided. The cleaning unit 37 contacts the electrostatic latent image carrying surface 33*a* with a predetermined pressure, at the downstream of the transferring portion TP in the movement direction of the electrostatic latent image carrying surface 33*a* by the rotation of the photosensitive drum 33.

The exposing unit 4 is provided above the drum frame 31. The exposing unit 4 includes an exposing-unit cover 41, a polygon mirror 42, and reflecting mirrors 43, 44, and 45.

The polygon mirror 42 is supported by a rotation shaft of a motor (not shown) fixed to the exposing-unit cover 41 such that the polygon mirror 42 rotates at a predetermined speed. The polygon mirror 42 is configured such that the polygon mirror 42 reflects a laser beam generated in a laser generating unit (not shown) based on image data while rotating by the above-described motor, such that scanning with the laser beam is performed along the sheet width direction. The reflecting mirrors 43, 44, and 45 are supported in the exposing-unit cover 41 to be capable of irradiating the laser beam (shown by an alternate long and short dash line in FIG. 1) reflected by the polygon mirror 42, onto the electrostatic latent image carrying surface 33*a*.

The sheet feeding unit 5 includes a sheet feeding roller 51, a paper-dust removing roller 52, upstream sheet guides 53 and 54, and a lower registration roller 55, and a downstream sheet guide 56.

The sheet feeding roller 51 is rotatably supported by the main body frame 11. The sheet feeding roller 51 opposes the separating pad 23 such that the peripheral surface of the sheet feeding roller 51 contacts the separating pad 23 with a predetermined pressure. The paper-dust removing roller 52 is rotatably supported at a position closer to the front side than the separating pad 23 (on the downstream in a rotation direction of the sheet feeding roller 51 when a sheet is fed) by the main body frame 11. The paper-dust removing roller 52 is provided such that the peripheral surface of the paper-dust removing roller 52 contacts the sheet feeding roller 51.

The upstream sheet guides 53 and 54 are provided to guide a sheet P up to a position where the upper registration roller 36 and the lower registration roller 55 oppose each other, along the sheet conveyance path PP. The lower registration roller 55 is provided below the sheet conveyance path PP to oppose the upper registration roller 36 with the sheet conveyance path PP interposed therebetween. The lower registration roller 55 is a roller for regulating a direction and conveyance timing of a sheet P in cooperation with the upper registration roller 36, and is provided at the upstream of the transferring portion TP in the sheet conveyance direction to contact the upper registration roller 36.

The fixing unit 6 is provided at the downstream of the transferring portion TP in the sheet conveyance direction. The fixing unit 6 includes a fixing-unit cover 61, a heating roller 62, and a pressing roller 63.

The fixing-unit cover 61 is interposed between the process cartridge 3, and the heating roller 62 and the pressing roller 63, such that the process cartridge 3 is less heated as possible. The heating roller 62 is configured by putting a halogen lamp in a metal cylinder with a release-processed surface, and is rotatably supported in the fixing-unit cover 61, such that the heating roller 62 can rotate in a direction shown by an arrow in FIG. 1, by the motor (not shown). The pressing roller 63 is a silicon rubber roller, and is rotatably supported in the fixing-unit cover 61 such that the pressing roller 63 is driven by the heating roller 62, so as to rotate in a direction shown by an arrow in FIG. 1 while being pressed against the heating roller 62 with a predetermined pressure.

The sheet discharging unit 7 is provided at the downstream of the fixing unit 6 in the sheet conveyance direction, and includes sheet conveyance rollers 71, sheet discharging rollers 72, and a sheet guide 73. The sheet conveyance rollers 71 are a pair of rollers which are driven to rotate by a motor (not shown), and are provided in the vicinity of the fixing unit 6. The sheet discharging rollers 72 are a pair of rollers which are driven to rotate by a motor (not shown), and are provided in the vicinity of the sheet discharging opening 12*c*. The sheet guide 73 is provided to guide a sheet P along the sheet conveyance path PP from the sheet conveyance rollers 71 to the sheet discharging rollers 72.

<Detailed Configuration of Drum Frame>

The drum frame 31 includes a pair of side plates 311, an upper beam 312, and a lower plate 313. The upper beam 312 and the lower plate 313 extend between the pair of side plates 311. The upper beam 312 supports the charging unit 34 and the cleaning unit 37 above the sheet conveyance path PP.

At the lower plate 313, a sheet entrance opening 313*a* is provided at the upstream of the transferring portion TP and at the downstream of the upper registration roller 36 in the sheet conveyance direction. The sheet entrance opening 313*a* is formed as a slit-shaped opening along the sheet width direction. In other words, the sheet entrance opening 313*a* is formed to have a width slightly larger than a width corresponding to the largest sheet size for the laser printer 1 (for example, about 210 mm in a case where the largest sheet size is an A4 size) (by at least about several mm) Further, at the lower plate 313, a sheet exit opening 313*b* is provided at the downstream of the transferring portion TP in the sheet conveyance direction. The sheet exit opening 313*b* is also formed to have the same width as that of the sheet entrance opening 313*a*.

Between the sheet entrance opening 313*a* and the sheet exit opening 313*b* of the lower plate 313 of the drum frame 31, a transfer-roller cover 314 and a guide-film supporting member 315 are provided below the sheet conveyance path PP (that is, on the transfer roller 35 side). The transfer-roller cover 314 is a plate member having a substantially U shape as seen in a side sectional view, and is provided to cover the transfer roller 35 from below.

The guide-film supporting member 315 (an example of a guide-member supporting frame) is provided at the upstream of the transfer roller 35 in the sheet conveyance direction, to reliably guide a sheet P to the transferring portion TP. Specifically, the guide-film supporting member 315 is formed integrally with the transfer-roller cover 314, to extend from an upper edge portion of the transfer-roller cover 314 on the sheet entrance opening 313*a* side toward the sheet entrance opening 313*a*. The guide-film supporting member 315 is attached with a guide film 316 (an example of a guide member).

Figure 2:
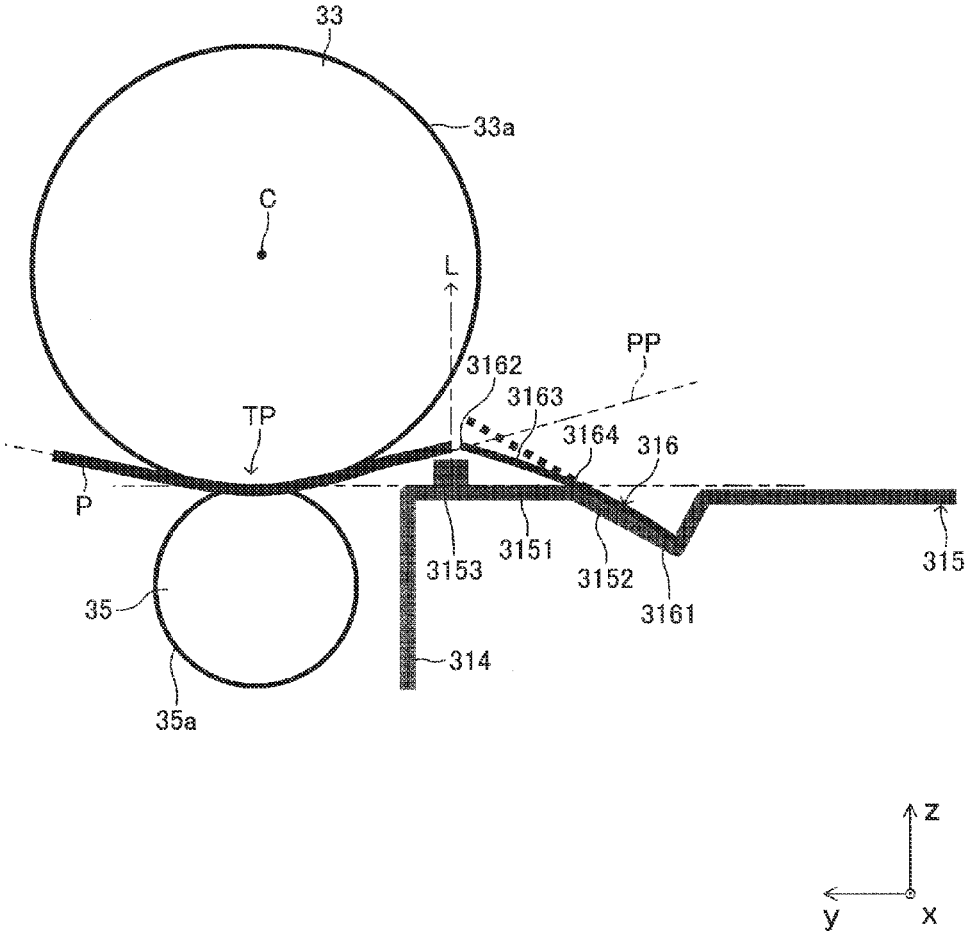
FIG. 2 is an enlarged side sectional view illustrating a guide-film supporting member shown in FIG. 1.

FIG. 2 is an enlarged side sectional view illustrating the guide-film supporting member 315 shown in FIG. 1. Hereinafter, the configuration and arrangement of the guide-film supporting member 315 and the guide film 316 will be described in detail with reference to FIG. 2.

The guide-film supporting member 315 includes a conveyance-surface opposing portion 3151 and a guide-film fixing portion 3152. The conveyance-surface opposing portion 3151 is a substantially plate portion adjacent to the transfer-roller cover 314 in the guide-film supporting member 315, and is provided to oppose the sheet conveyance path PP. Specifically, in the present illustrative embodiment, the conveyance-surface opposing portion 3151 is provided at a position slightly lower than a straight line connecting both edges of the transferring portion TP along the sheet conveyance path PP (on the photosensitive drum 33 side) as seen in a side sectional view.

The guide-film fixing portion 3152 has an inclined surface which is directed obliquely downward toward the front side from an end portion of the conveyance-surface opposing portion 3151 on the upstream side in the sheet conveyance direction. In other words, the guide-film fixing portion 3152 supports the guide film 316 on the inclined surface, such that the guide film 316 protrudes upward (toward the photosensitive drum 33 side) than the transferring portion TP as seen in a side sectional view.

Between the transferring portion TP and the guide film 316, a protrusion supporting member 3153 protrudes toward the sheet conveyance path PP from the conveyance-surface opposing portion 3151, to support a trailing edge of a sheet P which is passing on the guide film 316. In the present illustrative embodiment, the protrusion supporting member 3153 is provided at a position corresponding to an end portion of the conveyance-surface opposing portion 3151 on the downstream side in the sheet conveyance direction.

In the present illustrative embodiment, the protrusion supporting member 3153 is made of a non-foaming (that is, not foaming sponge) and inflexible material (that is, not flexible rubber), and is formed integrally with the conveyance-surface opposing portion 3151 seamlessly. In other words, the protrusion supporting member 3153 is made of the same material as a synthetic resin having predetermined rigidity for forming the drum frame 31. Further, the protrusion supporting member 3153 is formed in a rigid shape as seen in a side sectional view (that is, a shape other than a cantilevered thin plate shape as seen in a side sectional view). Specifically, in the present illustrative embodiment, the protrusion supporting member 3153 is formed in a substantially rectangular shape (more specifically, a square shape) as seen in a side sectional view.

The guide film 316 is a flexible member having a thin plate shape as seen in a side sectional view, and is provided below the sheet conveyance path PP (on the transfer roller 35 side) at the upstream of the transferring portion TP in the sheet conveyance direction, to guide a sheet P to the transferring portion TP. The guide film 316 is supported in the above-described manner by the guide-film supporting member 315. In other words, a base end portion 3161 which is an end portion of the guide film 316 on the upstream side in the sheet conveyance direction is fixed to the guide-film fixing portion 3152. Further, the guide film 316 is supported such that a free end 3162 which is a tip end of the guide film 316 on the downstream side in the sheet conveyance direction protrudes toward the sheet conveyance path PP and toward the downstream side in the sheet conveyance direction from the base end portion 3161.

In FIG. 2, a state of the guide film 316 at a time when there is no sheet P (before a leading edge of a sheet P reaches or after a trailing edge of a sheet P passes) is shown by a dotted line, and a normal curvature state when a normal sheet P (commercially so-called plain sheet) is passing is shown by a solid line. As shown in FIG. 2, the guide film 316 has a swing portion 3163 on the opposite side to the base end portion 3161 (closer to the free end 3162 side than the base end portion 3161). The swinging portion 3163 is closer to the sheet conveyance path PP than the base end portion 3161, and is on the downstream of the base end portion 3161 in the sheet conveyance direction. The swing portion 3163 is configured to swing according to the passing of a sheet P.

Here, the guide film 316 is provided so as to abut the protrusion supporting member 3153 while the guide film 316 does not protrude from the protrusion supporting member 3153 in the sheet conveyance direction when the swing portion 3163 swings according to the passing of a sheet P. In other words, the protrusion supporting member 3153 is provided at a position where the protrusion supporting member 3153 abuts the swing portion 3163 while the swing portion 3163 does not protrude toward the transferring portion TP side from the protrusion supporting member 3153 when the swing portion 3163 fully swings by abutting a sheet P in a direction of separating away from the sheet conveyance path PP (in other words, the swing portion 3163 approaches a conveyance-surface opposing portion 3151).

More specifically, in the present illustrative embodiment, a portion of the guide film 316 abutting the guide-film supporting member 315, which is closet to the transferring portion TP when the swing portion 3163 fully swings by abutting a sheet P to move away from the sheet conveyance path P is referred to as a supporting portion 3164. Further, a direction perpendicular to a straight line connecting the supporting portion 3164 and the transferring portion TP (a straight line connecting the supporting portion 3164 and the center point of the transferring portion TP in the sheet conveyance direction as shown by an alternate long and short dash line extending in left-right direction in FIG. 2) and also perpendicular to an rotation axis line C of the transfer roller 35 (a center axis line of the transfer roller 35 which is parallel to the sheet width direction) is referred to as a conveyance-surface normal direction (an alternate long and short dash line extending in the vertical direction in FIG. 2). The protrusion supporting member 3153 is provided at a position where the protrusion supporting member 3153 overlaps the free end 3162 in the conveyance-surface normal direction L when the swing portion 3163 abuts the protrusion supporting member 3153.

In the present illustrative embodiment, an end portion of the protrusion supporting member 3153 on the sheet conveyance path PP side is provided to protrude toward the sheet conveyance path PP from a straight line connecting the supporting portion 3164 and the transferring portion TP (a straight line connecting the supporting portion 3164 and the center point of the transferring portion TP in the sheet conveyance direction as shown by an alternate long and short dash line in FIG. 2).

<Operations and Effects of Illustrative Embodiment>

Next, operations and effects according to the above-described illustrative embodiment will be described below with reference to the drawings.

In the present illustrative embodiment, even if a trailing edge of a sheet P passes the free end 3162 of the guide film 316, the trailing edge is reliably (rigidly) supported by the protrusion supporting member 3153 protruding toward the sheet conveyance path PP at the downstream of the guide film 316. Thus, it is possible to effectively suppress a trailing edge of a sheet P from being rapidly separated from the electrostatic latent image carrying surface 33*a* after the trailing edge of the sheet P passes the guide film 316. Therefore, in the vicinity of a trailing edge of a sheet P, occurrence of disturbance in transfer of a toner image is readily suppressed.

Particularly, the protrusion supporting member 3153 is provided at a position where the swing portion 3163 of the guide film 316 does not protrude toward the transferring portion TP and the free end 3162 is supported from below, when the swing portion 3163 of the guide film 316 swings to approach the guide-film supporting unit 315 (that is, in a direction of separating away from the sheet conveyance path PP) by abutting a sheet P. Therefore, after the trailing edge of the sheet P passes the guide film 316, the trailing edge certainly abuts the protrusion supporting member 3153 and is reliably supported by the protrusion supporting member 3153. Further, when a relatively thick sheet P passes, the swing portion 3163 of the guide film 316 is reliably supported by the protrusion supporting member 3153.

Further, the end portion of the protrusion supporting member 3153 on the sheet conveyance path PP side is provided to protrude toward the sheet conveyance path PP from the straight line (see an alternate long and short dash line in FIG. 2) connecting the supporting portion 3164 and the transferring portion TP. Therefore, it is possible to effectively suppress a sheet P from being rapidly separated from the electrostatic latent image carrying surface 33*a* after the trailing edge of the sheet P passes the free end 3162 of the guide film 316 until the trailing edge reaches the transferring portion TP.

EXAMPLES OF MODIFICATION

While the present invention has been shown and described with reference to certain illustrative embodiments thereof, it will be understood by those skilled in the art that various changes in form and details may be made therein without departing from the spirit and scope of the invention as defined by the appended claims.

An image forming apparatus which is applied with an inventive concept of the present invention is not limited to the laser printer. The inventive concept of the present invention can be widely applied to image forming apparatuses having a mechanism of transferring a charged toner. Therefore, the image carrier is not limited to an electrostatic latent image carrier such as the photosensitive element. Further, even in a case where the image carrier is an electrostatic latent image carrier such as the photosensitive element, the electrostatic latent image carrier is not limited to a drum-shaped electrostatic latent image carrier.

The protrusion shape of the protrusion supporting member 3153 may be a semi-circle shape, a semi-elliptical shape, a triangular shape, a trapezoidal shape, or the like as seen in a side sectional view. The sectional shape of the protrusion supporting member 3153 may be hollow as long as the protrusion supporting member 3153 does not elastically deform by abutting a sheet P. Further, the protrusion supporting member 3153 may be attached to the conveyance-surface opposing portion 3151 by bonding or the like. Furthermore, the material of the protrusion supporting member 3153 may be a synthetic resin which has the same extent of rigidity as that of the drum frame 31 but is different from the drum frame 31 in the kind.

It is apparent that even unspecified modifications are included in the technical scope of the present invention without changing the essential part of the present invention. Further, in individual elements constituting a means for achieve the object of the present invention, an operationally and functionally represented element includes any configuration that can implement the operation and function, in addition to the specific configuration disclosed in the above-described illustrative embodiment and modifications. Furthermore, the contents of JP2003-5535A, JP2006-301490A, JP2008-26808A and JP2008-26809A are incorporated herein by reference and can be applicable within the technical scope of the present invention.

What is claimed is:

1. A transfer apparatus comprising:

a transfer roller which opposes an image carrier, wherein the transfer roller is configured to transfer developer carried on a peripheral surface of the image carrier onto a recording medium conveyed along a conveyance path, and wherein the transfer roller is further configured to rotate in synchronization with the recording medium when the recording medium is conveyed along the conveyance path;

a guide-member supporting frame which is provided upstream of a transferring portion in the conveyance path, wherein the transferring portion is a portion of the conveyance path where the image carrier and the transfer roller are closest to one another, and wherein the guide-member supporting frame is provided on a same side of the conveyance path as the transfer roller;

a flexible guide member which has a thin plate shape, which is attached to the guide-member supporting frame upstream of the transferring portion in the conveyance path, and which is configured to guide the recording medium to the transferring portion; and an inflexible protrusion which has a rigid shape, which is provided on the guide-member supporting frame between the transferring portion and the guide member in the conveyance path, and which protrudes toward the conveyance path such that the protrusion supports a trailing edge of the recording medium after the trailing edge of the recording medium passes the guide member, wherein the guide member includes:

a fixed portion which is fixed to the guide-member supporting frame; and a swing portion which is provided downstream of the fixed portion in the conveyance path, and wherein the swing portion is disposed closer to the conveyance path than the fixed portion, and wherein the protrusion is configured to abut the guide member when the swing portion of the guide member swings towards the guide-member supporting frame by abutting the recording medium, and wherein, when the protrusion abuts the guide member, the guide member does not extend downstream of the protrusion in the conveyance path.

2. The transfer apparatus according to claim 1, wherein a portion of the guide member which abuts the guide-member supporting frame and which is closest to the transferring portion when the swing portion of the guide member swings towards the guide-member supporting frame by abutting the recording medium is defined as a supporting portion, wherein a direction which is perpendicular to a straight line connecting the supporting portion and the transferring portion, and which is perpendicular to a rotation axis line direction of the transfer roller, is defined as a conveyance-surface normal direction, and wherein the protrusion is provided at a position such that a free end of the guide member overlaps the protrusion in the conveyance-surface normal direction when the swing portion abuts the protrusion.

3. The transfer apparatus according to claim 1, wherein the protrusion is made of a non-foaming synthetic resin.

4. The transfer apparatus according to claim 3, wherein the protrusion is formed integrally with the guide-member supporting frame.

5. The transfer apparatus according to claim 1, wherein the protrusion protrudes toward the conveyance path from a straight line connecting the transferring portion and a supporting portion of the guide member, wherein the supporting portion of the guide member is a portion of the guide member which abuts the guide-member supporting frame and which is closest to the transferring portion when the swing portion of the guide member swings towards the guide-member supporting frame by abutting the recording medium.

* * * * *